United States Patent [19]

Nakai et al.

[11] Patent Number: 4,600,605

[45] Date of Patent: Jul. 15, 1986

[54] METHOD OF PRODUCING STRETCHABLE WADDING

[75] Inventors: Kiyoto Nakai; Kanji Hosokawa, both of Moriyama, Japan

[73] Assignee: Japan Vilene Co., Ltd., Tokyo, Japan

[21] Appl. No.: 642,266

[22] Filed: Aug. 20, 1984

[51] Int. Cl.[4] ..... B05D 1/02; B05D 3/02

[52] U.S. Cl. ..... 427/379; 427/385.5; 427/421; 428/230; 428/235; 428/290; 428/913

[58] Field of Search ..... 428/300, 286, 230, 235, 428/369, 224, 913, 290; 427/208.2, 379, 381, 389.9, 394, 421, 385.5

[56] References Cited

U.S. PATENT DOCUMENTS 3,927,229 12/1975 Rall et al. ..... 427/381
4,148,958 4/1979 Tischer ..... 428/235
4,292,365 9/1981 Kane et al. ..... 428/369

FOREIGN PATENT DOCUMENTS 2054884 5/1971 France ..... 428/300
45-16262 5/1970 Japan ..... 428/300

*Primary Examiner*—Paul J. Thibodeau
*Attorney, Agent, or Firm*—Pahl, Lorusso & Loud

[57] ABSTRACT

A stretchable wadding with an apparent density of 0.005 to 0.05 g/cm$^3$ formed from a web of crimp potential fibers bonded together and shrunk by drying is disclosed. In the preferred embodiment, crimp potential fibers are bonded to each other by spraying an adhesive onto both sides of the web, drying the adhesive, and shrinking the web by means of additional heat treatment to crimp the fibers.

4 Claims, No Drawings

METHOD OF PRODUCING STRETCHABLE WADDING

BACKGROUND OF THE INVENTION

The present invention relates to a method of producing stretchable wadding using crimp potential fibers.

It is generally known that wadding can be produced using a carding machine to form a web from fibers having a large number of crimps, subjecting the web to treatment such as needling, and subsequently bonding the component fibers of the web to each other. One difficulty with such a method is that the fibers are bonded with each other in their crimped areas, reducing the freedom of the fibers, and making it impossible to obtain wadding with good stretchability. Another difficulty is that if fibers having a larger number of crimps are used, carding efficiency is adversely affected due to increased interlocking of fibers, and the resulting webs are substantially irregular. Wadding produced by this conventional method is therefore unsuitable for use in sportswear and other garments which require adaptability to severe body movement, though it may be used in an application such as quilting which does not require as much stretchability.

To overcome this problem, it has been proposed to introduce an elastic yarn formed of a polyurethane elastomer or the like into the web to impart stretchability. This method has the disadvantage that it requires an apparatus and a process step for the introduction of such an elastic yarn. Moreover, the wadding produced does not have sufficient stretchability in portions in which no elastic yarn is present, and is therefore subject to creasing or partial shrinking.

The present invention, made with a view to overcoming such difficulties, has as its object the provision of a method of producing wadding with good and uniform stretchability.

SUMMARY OF THE INVENTION

The present invention provides a method for producing stretchable wadding with an apparent density of 0.005 to 0.05 g/cm$^3$ which comprises forming a web containing crimp potential fibers, spraying an adhesive over the web, drying the web at such temperatures as will not allow complete crimping of the crimp potential fibers, and subsequently shrinking the web by crimping the crimp potential fibers.

DETAILED DESCRIPTION OF THE INVENTION

Among the various types of crimp potential fibers available for the purpose of the present invention are side-by-side type bicomponent fibers which have two polymer components which differ in thermal behavior from each other, thermoplastic fibers in which the fibers have been heat set while being held in high twist condition and subsequently untwisted at a lower temperature, and fibers such as edge crimped yarn wherein the fibers have been given crimp potential by disturbing the molecular arrangement on one side of the fibers. Since the stretchability of any wadding is determined by crimping of the component fibers, the larger the number of crimps of the fiber, the more satisfactory the stretchability. Therefore, it is preferable that the crimp potential fibers should be such that the number of crimps increases substantially with crimping.

According to the present invention, web formation is carried out by carding. The fibers constituting the web should include at least 30% by weight, or preferably more than 50% by weight, crimp potential fibers. It is difficult to obtain a wadding with sufficient stretchability if the proportion of the crimp potential fibers contained in the web is less than 30% by weight. The greater the amount of crimp potential fibers contained in the web, the better the stretchability of the wadding produced. Therefore, in order to obtain the most favorable stretchability, the web should be formed solely of crimp potential fibers. For a mixture containing crimp potential fibers to form a web, it is advisable to use fibers having as many crimps as feasible, provided they will not hinder the carding efficiency or web uniformity. It is undesirable, though not impossible, to use fibers having a relatively small number of crimps, because they may decrease the stretchability of the resulting wadding. The use of crimp potential fibers permits good carding efficiency and efficient production of uniform webs. After web formation, treatment such as needling may be made as required.

After web formation, an adhesive, such as an acrylic resin emulsion, is applied to the web spraying strap. In order to provide the wadding with stretchability, good thickness-directional resiliency, and bulkiness, adhesive points must be distributed three-dimensionally. Accordingly, application by spraying is preferred. In addition to spraying, thermoadhesive fibers may be used to provide three-dimensional distribution of adhesive points. If such a method is used, however, it is possible that when the crimp potential fibers are crimped, the thermoadhesive fibers may bond the crimped portions of the crimp potential fibers with other fibers, adversely affecting the stretchability of the product. It is therefore undesirable to use thermoadhesive fibers as the main means of adhesion between fibers, although such fibers may be used as auxiliary adhesive means in conjunction with spraying of adhesive.

After the adhesive is sprayed onto the web, the web is dried, effecting interfiber bonding.

At this stage of operation, if the crimp potential fibers are crimped by the drying heat, uneven shrinkage is caused in the web which results in dimensional deformation and/or unsatisfactory stretchability. Temperature for drying should be controlled within such a range that the crimp potential fibers will not be completely crimped. Local crimping, during the drying step and prior to subsequent heat treatment, may be allowed insofar as stretchability is not damaged.

After drying, the crimp potential fibers are crimped using means such as heating or hot water treatment which shrink the web. In order to obtain a wadding having good stretchability, it is desirable not to apply tension wherever possible when shrinking the web. Any tension applied to the web may cause the fibers to be fixed as stretched in the direction of the tension and sufficient shrinkage of the web may not take place, adversely affecting the stretchability of the wadding produced.

Drying the web and shrinking the crimp potential fibers are preferably effected using separate and independent dryers. However, a single dryer that will not shrink the crimp potential fibers until the web is dried may also be used.

The apparent density of the wadding produced in the present invention is preferably 0.005 to 0.05 g/cm$^3$, or more preferably 0to 01 to 0.03 g/cm$^3$, from the standpoints of heat retaining quality and tensile strength.

As previously described, according to the present invention, crimp potential fibers are used so that web formation by means of a carding machine or the like may be efficiently carried out; and a spray bonding method is employed for interfiber adhesion so that a wadding with high bulkiness and thickness-directional resiliency may be obtained. Furthermore, according to the present invention, after interfiber bonding is effected, the crimp potential fibers are crimped so as to effect shrinking of the web, forming a multiplicity of crimps remaining free and unbonded in the web. Using this process, waddings having uniform and satisfactory stretchability can be produced.

The wadding produced by the process of the present invention not only has good stretchability, but also has high resistance to washing due to adhesive treatment by spraying. The wadding so produced can be used for applications requiring good stretchability, such as in sportswear and winter garments, as well as for heat retaining applications, such as bedding and gloves.

The invention will now be explained in further detail with reference to the following examples. It is to be understood that the invention is in no way limited to the examples. In the examples, residual percentage strain is used to express stretchability. Strain values are based on measurements of tests made in compliance with JIS L-1080. That is, the test piece is stretched by 40% and then allowed to return to its original position; after this process is repeated 10 times, the residual elongation is divided by the initial length of the test piece, the value being expressed in percentage terms.

EXAMPLE 1

Fifty percent by weight of polyester fibers, 3 denier in thickness, 51 mm in staple length, and 17 crimps/inch, which have been given crimp potential by edge crimping, and 50% by weight of conjugate type high-crimp polyester fibers, 3 denier in thickness, 51 mm in staple length, and 17 crimps/inch, were mixed. The mixture was formed into a web of 38 g/m$^2$ by cross lay carding. A polyacrylic ester emulsion was sprayed on both sides of the web, and the web dried in a dryer at a temperature less than 100° C. The weight of the web at the time was 44 g/m$^2$. After drying, the crimp potential fibers were crimped, using a dryer heated to 170° C., in such a way that little or no pressure was applied to the web, to shrink the web. After crimping, the crimp potential fibers had 34 crimps/inch, and the web was shrunk 17% in the longitudinal direction and 23% in the width direction.

The wadding obtained had a weight of 70 g/m$^2$, a thickness of 7 mm, and an apparent density of 0.01 g/cm$^3$. The residual percent strain, representing the stretchability of the wadding, was 2.5% in the longitudinal direction and 1.5% in the width direction, thus proving that the wadding had very good stretchability. Furthermore, the wadding showed good stretchability after dry cleaning, with residual strain of 3.5% in the longitudinal direction and 2.0% in the width direction, thus proving that it had high resistance to dry cleaning.

REFERENCE EXAMPLE

One hundred percent by weight of conjugate type high-crimp polyester fibers, 3 denier in thickness, 51 mm in staple length, and 17 crimps/inch, were formed into a web of 38 g/m$^2$ by cross lay carding. Then, in the same manner as in Example 1, polyacrylic emulsion was sprayed over both surfaces of the web, and dried using a dryer at 150° C. The web then weighed 44 g/m$^2$.

The wadding thus obtained could not be measured as to longitudinal residual strain since it did not withstand repeated 40% longitudinal elongation, being subject to breakage in the course of the tests. The wadding showed poor stretch quality in the width direction, too, with a residual strain of 15%.

EXAMPLE 2

One hundred percent by weight of 4 denier, 51 mm long side-by-side type bicomponent fibers consisting of a polyester component having a melting point of 210° C. and a shrinkage start temperature of 160° C. and a polyester component having a melting point of 255° C. and a shrinkage start temperature of 230° C. was formed into a web of 55 g/m$^2$ in weight and 10 mm in thickness by means of an ordinary cross laying card. The web was then subjected to needling by means of a fiber locker to produce a felt-like web having a thickness of 4 mm. A polyacrylic ester emulsion was applied on both sides of the felt-like web by spraying, and the web was dried at 120° C. The weight of the web at that time was 63 g/m$^2$. After drying, the side-by-side type bicomponent fibers having crimp potential were crimped using a thermal shrinking machine, thereby shrinking the web. The web was shrunk 22% in the longitudinal direction and 38% in the width direction.

The wadding thus produced had a weight of 130 g/m$^2$, a thickness of 6 mm, and an apparent density of 0.022 g/cm$^3$. Residual strain measurements were 1.5% in the longitudinal direction of the wadding and 1.0% in the width direction, showing better stretchability than demonstrated in Example 1. The web, having been further improved in resiliency by needling, could successfully be made into a wadding ideal for use in such applications as sportswear and the like.

Although this invention has been described with reference to specific embodiments, it is understood that modifications and variations may occur to those skilled in the art. It is intended that all such modifications and variations be included within the scope of the amended claims.

What is claimed:

1. A method of producing stretchable wadding with an apparent density of 0.005 to 0.06 g/cm$^3$ and thickness-directional resiliency, which comprises:

(a) forming a non-woven web containing crimp potential fibers, (b) spraying an adhesive over the web to provide adhesive at points three-dimensionally distributed through the web, (c) drying the web at a temperature less than the temperature at which the fibers crimp, and (d) shrinking the web by heating to a temperature at which the fibers crimp to form a multiplicity of crimps remaining free and unbonded in the web.

2. The method according to claim 1 wherein the web is formed by carding.

3. The method according to claim 1 further comprising needling of the web before spraying adhesive onto the web.

4. A method in accordance with claim 1 wherein said drying is effected in a first dryer and said shrinking is effected in a second dryer separate and independent of said first dryer.

* * * * *